United States Patent [19]

Vermillion

[11] 4,391,069

[45] Jul. 5, 1983

[54] FREE STANDING WALL

[75] Inventor: Eugene F. Vermillion, Columbus, Ohio

[73] Assignee: The Columbus Show Case Company, Columbus, Ohio

[21] Appl. No.: 200,026

[22] Filed: Oct. 23, 1980

[51] Int. Cl.[3] ..... E04D 15/00

[52] U.S. Cl. ..... 52/126.4; 52/36; 52/243.1

[58] Field of Search ..... 52/126.3, 126.4, 239, 52/238 A, 241, 242, 293, 122, 36

[56] References Cited

U.S. PATENT DOCUMENTS

| | | | |
|---|---|---|---|
| 1,462,208 | 7/1923 | Mayo . | |
| 3,017,672 | 1/1962 | Vaughan . | |
| 3,101,817 | 8/1963 | Radek | 52/241 |
| 4,038,799 | 8/1977 | Shanks | 52/241 |
| 4,068,432 | 1/1978 | Davis | 52/241 |

FOREIGN PATENT DOCUMENTS

| | | | |
|---|---|---|---|
| 245216 | 2/1966 | Austria | 52/122 |
| 253177 | 3/1967 | Austria | 52/293 |
| 951076 | 7/1974 | Canada | 52/241 |
| 2344373 | 3/1975 | Fed. Rep. of Germany | 52/122 |
| 2447038 | 4/1976 | Fed. Rep. of Germany | 52/122 |

*Primary Examiner*—John E. Murtagh
*Assistant Examiner*—Henry E. Raduazo
*Attorney, Agent, or Firm*—William S. Rambo

[57] ABSTRACT

A prefabricated wall features coplanar triple-channelled upper cap and lower sill members joined in vertically spaced relation by vertical frame members rigidly fastened in the medial channels of the cap and sill members, and exterior panels removably carried in the lateral channels of the sill and cap members in covering relation to the vertical frame members. The sill member also includes an underlying channel which houses an adjustable leveling device upon which the sill is mounted.

4 Claims, 8 Drawing Figures

FREE STANDING WALL

BACKGROUND OF THE INVENTION

This invention relates generally to prefabricated walls, and more particularly to a prefabricated, free-standing wall having oppositely facing, exterior panels.

It is not uncommon for the interior of business establishments, especially stores, to be renovated or redecorated and, upon occasion, to require the addition of new walls to the pre-existing structure. In the past, prefabricated walls were little more than inflexible simulations of ordinary floor-to-ceiling walls and thus were ill-suited for modern, free-form office designs. In addition, they generally lacked the internal strength to support merchandise display shelves or racks typically found on ordinary store walls. The prefabricated walls disclosed in U.S. Pat. No. 1,462,208 to Mayo issued July 17, 1923 and U.S. Pat. No. 3,017,672 to Vaughan issued Jan. 23, 1962 are examples of the earlier prefabricated walls and represent the closest prior art known to the inventor. While both the Mayo and Vaughan prefabricated walls are constructed from a plurality of panels set side by side in upper and lower channelled brackets, neither wall includes structural features which would permit it to stand on its own without joining other walls or a ceiling or to support display devices.

One popular alternative to erecting a prefabricated wall was to bring in a crew and build a conventional stud wall on location. Although sturdier than some prefabricated walls, conventional stud walls required far more time and effort on the job site. The costs of construction were high both in terms of labor and time during which the area under construction was unproductive. The present wall preferably utilizes certain of the features disclosed in my copending application Ser. No. 178,148 filed Aug. 14, 1980 entitled CURTAIN WALL to which further reference will be made hereinafter, and additionally provides a free-standing wall which has sufficient strength and stability to support merchandise for display.

SUMMARY AND OBJECTS OF THE INVENTION

The present prefabricated wall comprises a lower, horizontally extending sill member that has longitudinally coextensive, upwardly opening, medial and first and second lateral channels; a plurality of load-bearing vertical frame members, each having a horizontal foot section at its lower end secured within the medial channel of the sill member and a horizontal head section at its upper end; an upper, horizontally extending cap member that has longitudinally coextensive, downwardly opening, medial and first and second lateral channels disposed in co-planar relationship to corresponding channels of the sill member, the medial channel of the cap housing the head sections of the vertical frame members; and a plurality of wall panels removably positioned in side by side relation within each of the lateral channels of the cap and sill members. A leveling apparatus is also provided in the present invention and preferably comprises a floor-mounted base member that has a plurality of externally threaded, upwardly extending anchoring posts; a plurality of internally threaded leveling columns variably mounted on the posts in horizontal alignment with one another; and a leveling column receiving, downwardly-opening channel on the lower sill member of the wall.

The primary object of the present invention is to provide a free-standing wall that can support merchandise display shelves or racks.

Another object of the present invention is to provide a prefabricated wall that can be quickly and easily assembled on location.

Further objects of the present invention will become apparent with reference to the following drawings and description of the preferred embodiment.

DESCRIPTION OF THE PREFERRED EMBODIMENT

Figure 1:
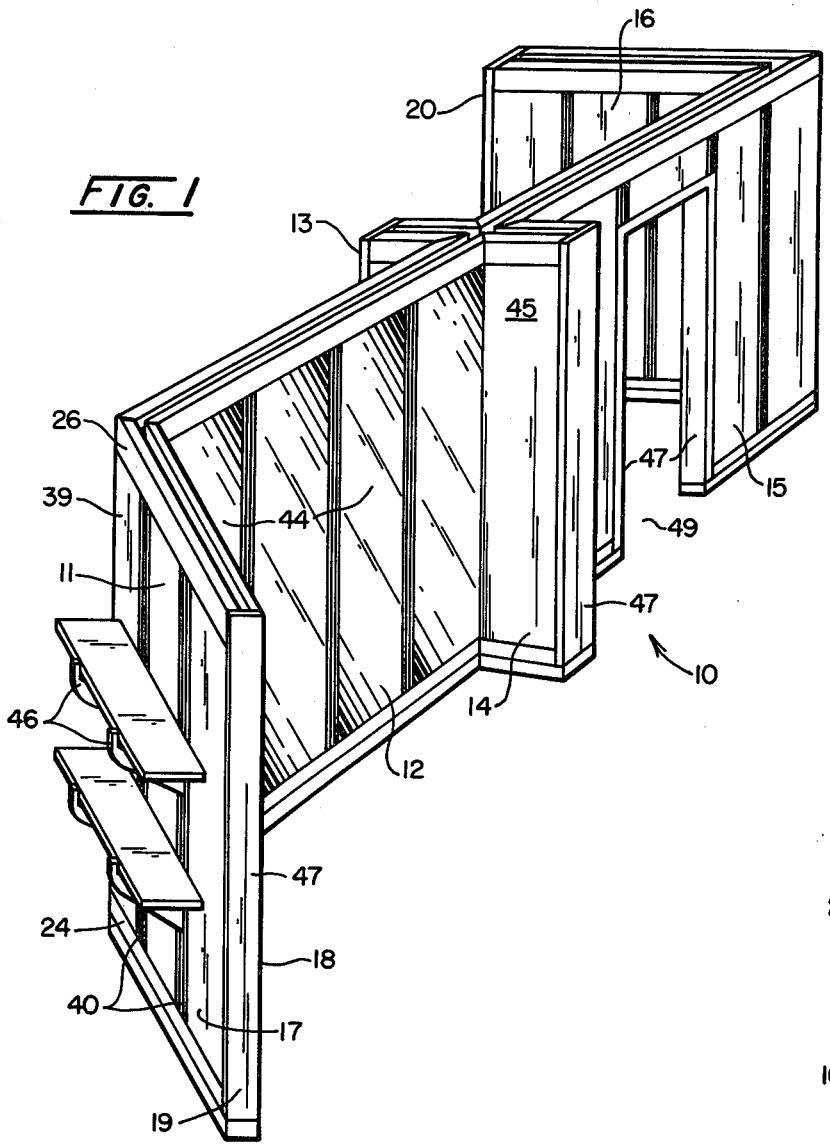
FIG. 1 is a perspective view of a prefabricated wall according to the present invention.
Figure 2:
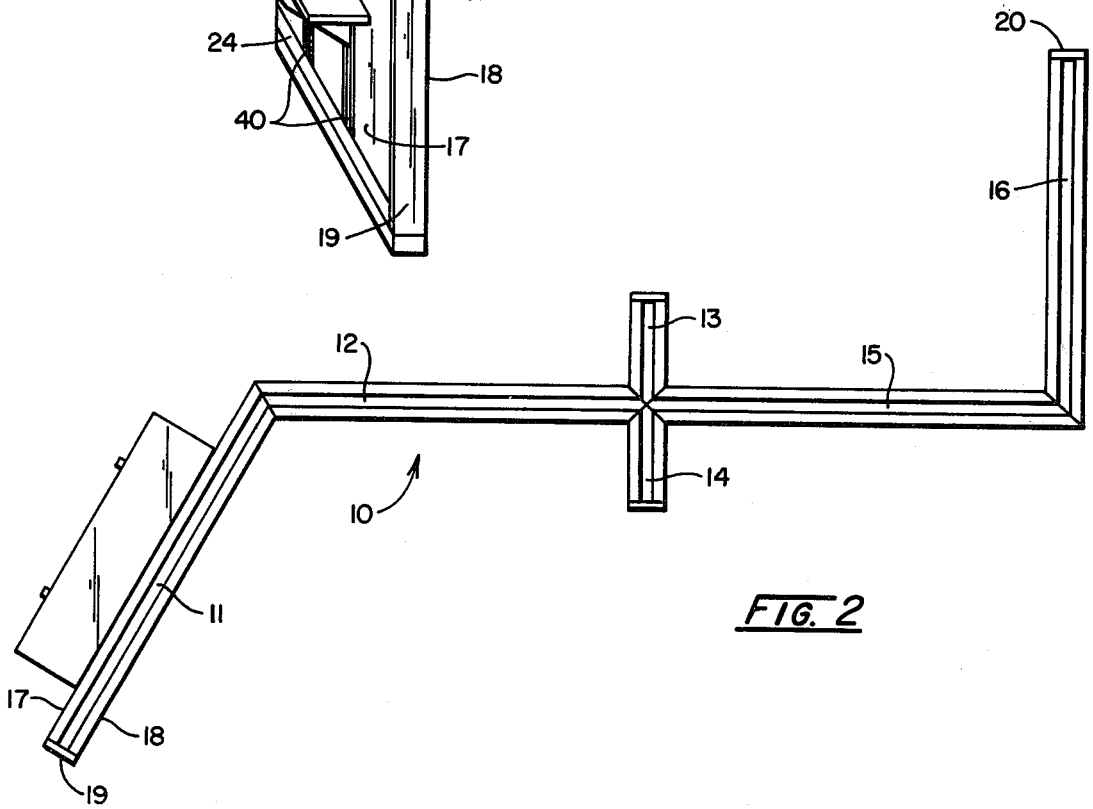
FIG. 2 is a top plan view of the wall.

As illustrated in FIGS. 1 and 2, the present prefabricated wall, generally designated 10, is free-standing and is preferably formed with a plurality of angularly related, relatively adjoining sections 11, 12, 13, 14, 15 and 16 having oppositely facing exterior surfaces 17 and 18. If desired, the wall could be perfectly straight and supported at its ends 19 and 20 by other structures; however, it is preferable to include relatively short, opposing, buttressing sections or ribs 13 and 14 at intervals of twenty feet or less along the length of a straight section of the wall.

Figure 3:
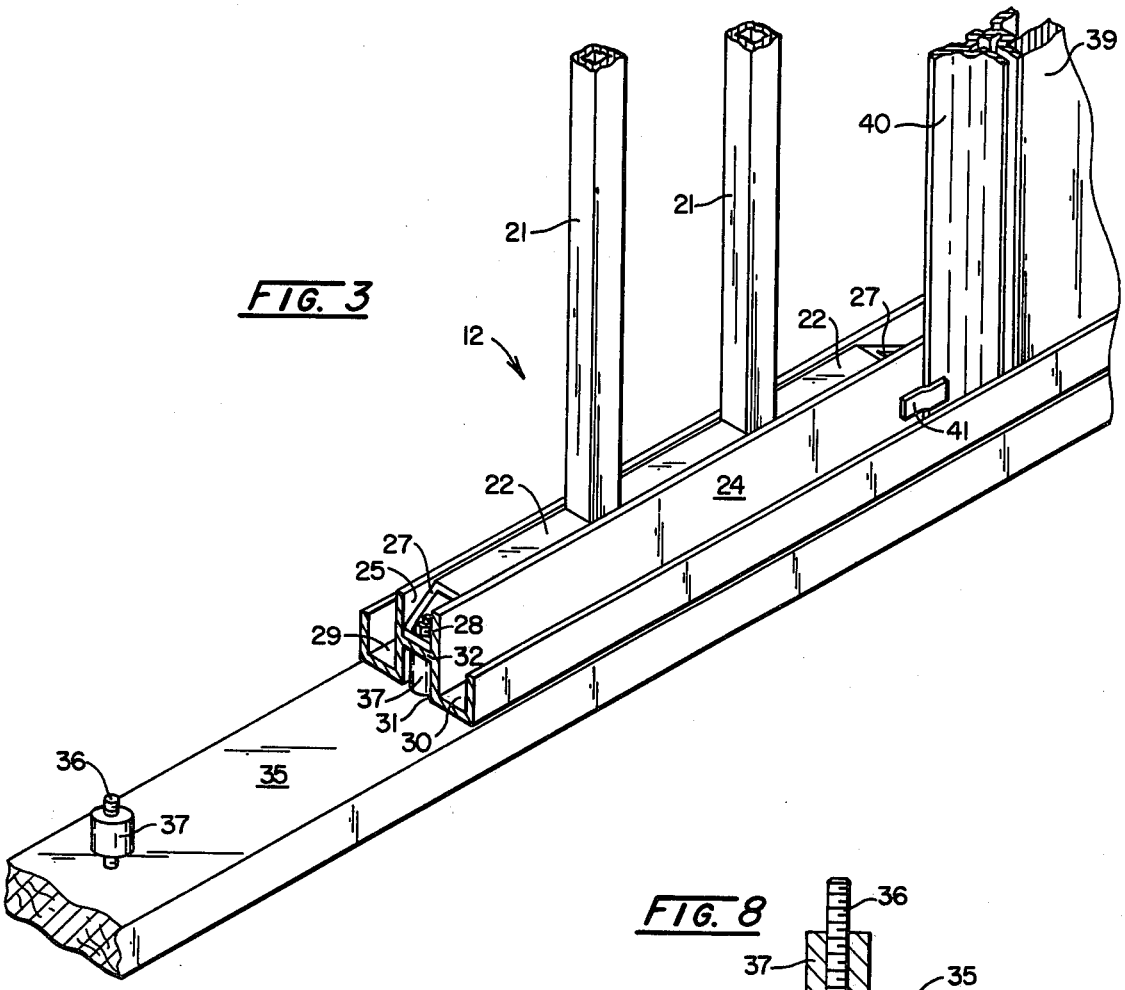
FIG. 3 is an enlarged, fragmentary perspective view, partially in section, of the leveling device, lower sill, vertical frame members and other features of the wall.
Figure 4:
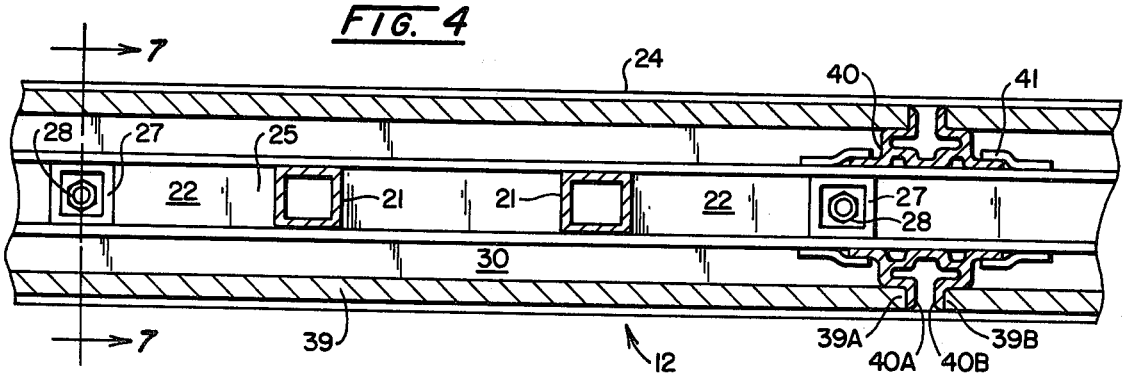
FIG. 4 is an enlarged, horizontal sectional view through the outer panels and vertical frame members in a straight section of the wall.
Figure 7:
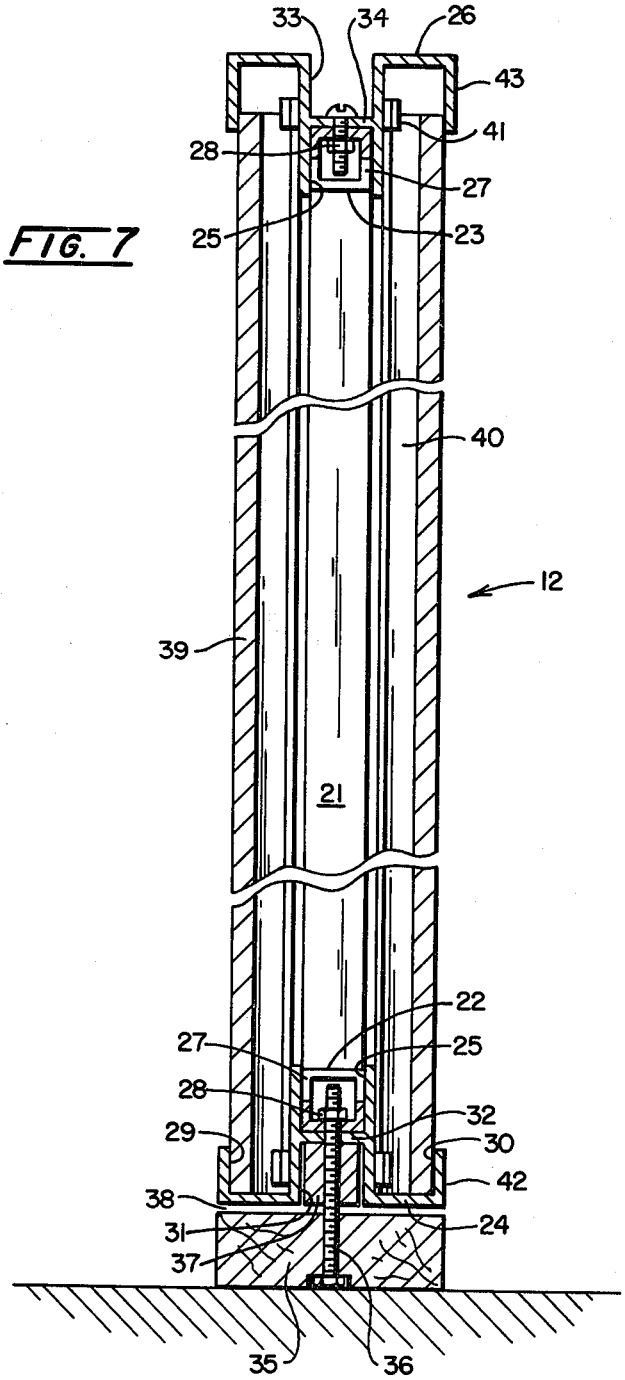
FIG. 7 is a vertical sectional view taken along the line 7—7 in FIG. 4.

The internal structure of a straight wall section 12 is illustrated in FIGS. 3, 4, and 7. A plurality of vertical frame members 21 which provide structural support for the wall lie in spaced apart relation therewithin. Each frame member 21 is provided with a horizontal foot 22 and a horizontal head 23 welded or otherwise rigidly attached to its lower and upper ends, respectively. Ordinarily, the vertical frame members and horizontal feet and heads are fashioned from hollow, rectangular shafts or rods of metal. Preferably, the vertical members 21 lying within the straight sections are arranged in pairs and share an elongated foot 22, head 23 and intermediate horizontal connector (not shown). Separate pairs of vertical members may be spaced approximately 48"–60" apart along a typical straight wall section.

A horizontally extending lower sill 24 houses the frame feet 22 within a longitudinally coextensive, upwardly opening medial channel 25. A horizontally extending upper cap 26 (FIG. 7) houses the frame heads 23 within a substantially similar but downwardly opening medial channel 25. The feet 22 and heads 23 may be bevelled at their free ends 27 to provide access to suitable fastening means 28 by which they are attached to their respective medial channels 25 in the sill and cap members. The fastening means 28 in the sill 25 preferably form part of a leveling apparatus described below. Both the sill 24 and cap 26 include first and second lateral channels 29 and 30 lying on opposite sides of and coextensive with their respective medial channels 25. Preferably, the sill and cap are extruded aluminum and have medial channels raised or offset from the lateral channels, as indicatd in FIG. 7. In this manner, the sill member 24 may be provided with a downwardly opening channel 31 immediately below its upwardly opening, medial channel 25, with a common closed end 32 therebetween. Similarly, the upper cap may include an upwardly opening channel 33 immediately above its downwardly opening medial channel 25 and common closed end 34.

Figure 8:
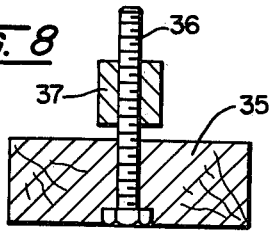
FIG. 8 is an enlarged, vertical sectional view of the leveling device.

Preferably, the sill 24 is installed, as indicated in FIGS. 3, 7 and 8, upon a leveling apparatus which comprises a floor-mounted base 35 and a plurality of anchoring posts 36 and leveling columns 37. The base or platform 35 is formed from longitudinally extending, relatively narrow planks of wood or other material laid end to end and rigidly secured to the floor to form the template upon which the present wall may be constructed. The base, in effect, follows the contour of the floor. The anchoring posts 36 are externally threaded, are rigidly fastened to the base, and extend upwardly therefrom. The leveling columns 37 are internally threaded to engage the posts 36. Thus, by simply turning the columns 37 in either a clockwise or counterclockwise direction, one may lower or raise them relative to the base 35 and anchoring posts 36 and establish a level, horizontal plane.

The downwardly-opening channel 31 of the sill receives the leveling columns 37, and the closed end 32 of the sill rests thereupon. The free ends of the anchoring posts 36 extend through openings in the closed end 32 and are secured by suitable fastening means 28 either to the medial channel 25 or to the foot sections 22 of the frame members lying therein. Thus, where the floor dips, a space 38 may form between the sill 25 and base 35 (FIG. 7).

As indicated in FIG. 1, the opposing external surfaces 17 and 18 of the wall are formed from a plurality of panels 39 standing within the lateral channels of the cap 26 and sill 24. These panels 39 are fabricated and assembled within the sill and cap channels in a manner disclosed in my copending application, Ser. No. 178,148 filed Aug. 14, 1980 and entitled CURTAIN WALL. As indicated in FIGS. 3 and 4, the panels 39 are held in position and separated by vertically extending, horizontally spaced-apart studs 40 whose upper and lower end portions extend into the lateral channels of the cap and sill members, respectively. The channels, in turn, are provided at longitudinally spaced intervals with stud-locating fingers 41 which detachably engage the upper and lower end portions of the studs 40. As illustrated in FIG. 7, the outer lips 42 of the lateral channels of the sill member are shorter than the outer lips 43 of the lateral channels of the cap member. Thus, during assembly of the wall, the upper ends of the studs 40 may be first lifted into the stud-locating fingers 41 of the cap, the lower ends of the studs are swung over the outer lip 42 of the sill and then inserted into the sill's stud locating fingers, without releasing the upper ends of the studs from contact with the upper fingers 41. In a similar manner, the exterior panels 39 may be inserted into the lateral channels of the cap and sill and into abutment along their lateral edges 39A and 39B, with the panel-separating webs 40A and 40B, respectively, of the studs.

As illustrated in FIG. 1, the exterior panels may provide the wall with a mirrored surface 44 or with less reflective material 45. In addition, shelf-supporting brackets 46 and other merchandise display appendages may be attached to the studs 40 in the manner described in my previously cited patent application.

Figure 5:
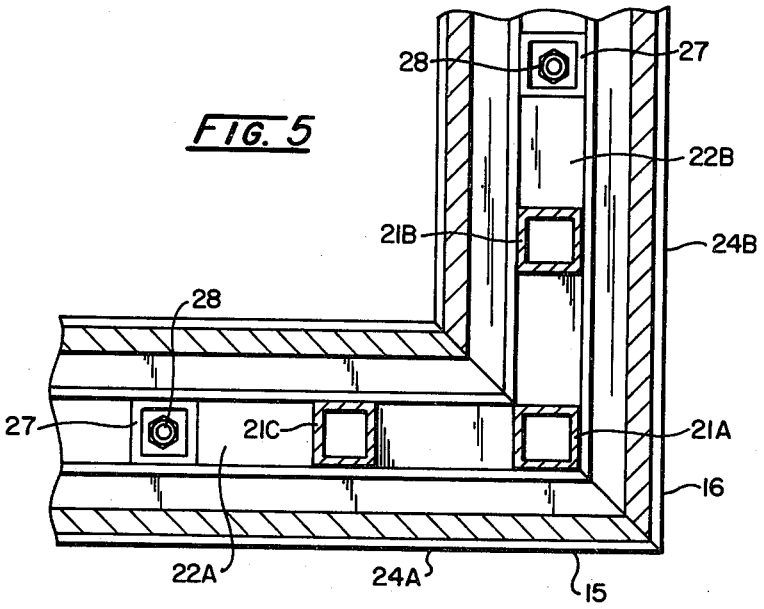
FIG. 5 is a similar view of a ribbed section of the wall.

In order to be substantially free of supporting or stabilizing attachments to other walls or a ceiling, the free standing wall 10 may have a number of angularly related, relatively adjoining sections. FIG. 5 illustrates a 90° joint between wall sections 15 and 16 in FIGS. 1 and 2. And, except for changes in angularity, a substantially identical arrangement of the wall's structural components can be used to construct the obtuse joint between wall sections 11 and 12. Referring to FIG. 5, one will note that three vertical frame members 21A–C are welded or otherwise secured to two relatively adjoining angularly related foot sections 22A and 22B. The angularly adjoining foot sections in turn, are set within the medial channels of and reinforce the adjoining sill sections 24A and 24B. The adjoining cap sections which are supported by the vertical members 21A–C are similarly connected and reinforced by angularly adjoined head sections (not shown). As with the straight foot 22, the angular foot sections 22A and 22B include bevelled end surfaces 27 that provide access to suitable attachment means 28. The angular head sections are similarly constructed.

Figure 6:
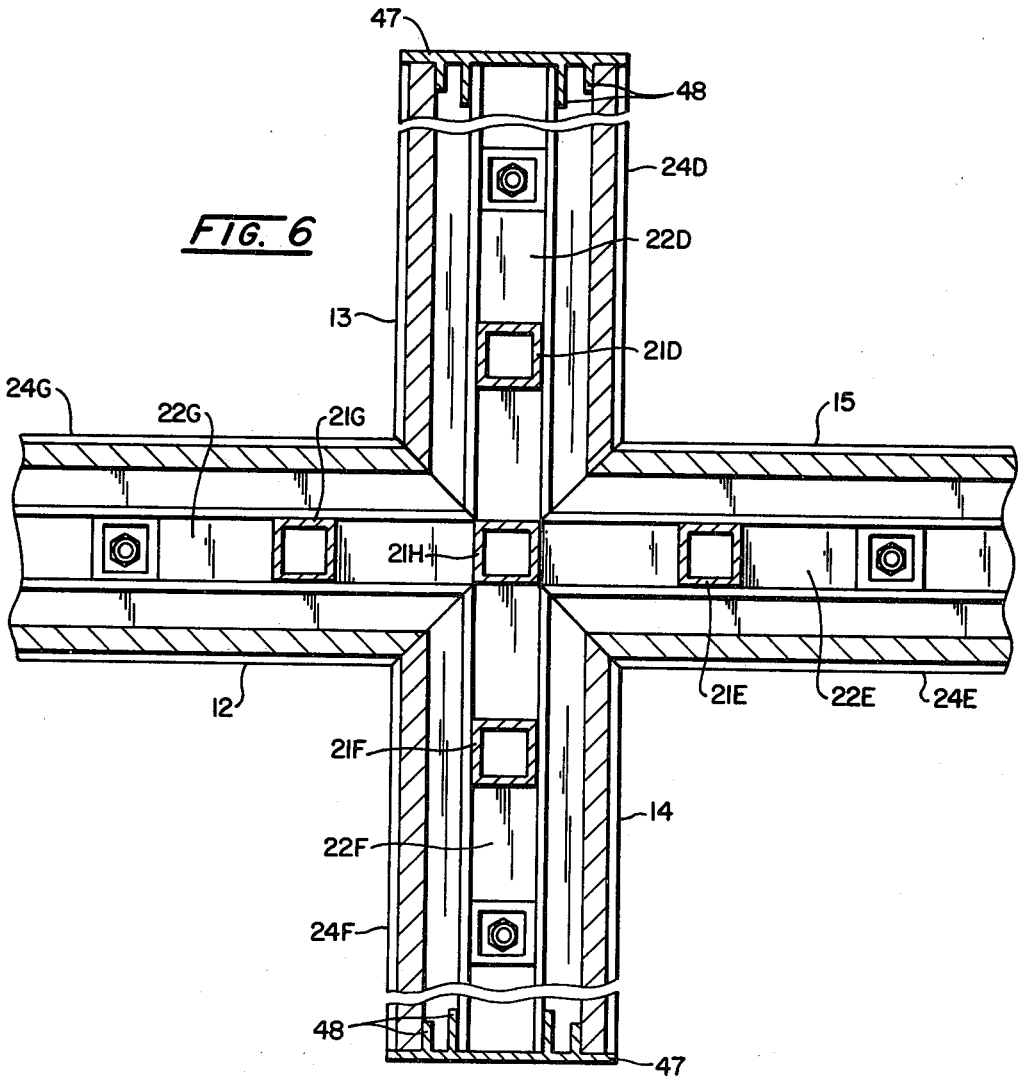
FIG. 6 is a similar view of an angled section of the wall.

An alternative or additional manner of making the wall self-stabilizing is to provide relatively opposing, stabilizing ribs or buttresses 13 and 14 at intervals between straight wall sections 12 and 15, as indicated in FIGS. 1, 2 and 6. Although substantially similar in construction to the straight wall sections 12 and 15, the ribs 13 and 14 are relatively attenuated structures that are joined to the straight sections by a cross-like configuration of vertical members and adjoining foot and head sections. As illustrated in FIG. 6, each of the adjoining sill sections 24D–G includes an outlying vertical frame member 21D–G and an associated foot section 22D–G. In addition, at the intersection of the various sill members, the foot sections are welded or otherwise attached together and a fifth vertical frame member 21H extends upwardly therefrom. A similar pattern of head sections joins the vertical frame members 21D–H and adjoining cap members (not shown).

The ribs 13 and 14 terminate in end caps or plates 47 which cover the ends of the sill 24 and the cap 26 and which have substantially flat external surfaces and a number of longitudinally coextensive, inwardly-projecting spines 48. In addition to their cosmetic function, the end caps 47 provide support to the ends of the external panels 39. Preferably, the innermost spines 48 are positioned to fit tightly against the walls of the medial channels of the sill and cap members, and the outlying spines help suppor the external panels. The end caps 47 may also be used at the free ends 19 and 20 of the wall or as framing pieces for a doorway 49 (FIG. 1).

In operation, the present free-standing wall may be rapidly assembled on site because its various components are fashioned to the required specifications before shipment from the manufacturer. The vertical frame members, for instance, may be joined with their respective horizontal feet and heads in the various configurations outlined above; the cap and sill members may be properly mitered; and the anchoring posts may be set within the pre-cut sections of the base at the factory. On location, the following, somewhat simplified, assembly procedure may be used: the base sections are laid out and secured to the floor; the leveling columns are adjusted to bring their top surfaces into a common horizontal plane; the sill sections are placed on the columns and anchoring posts; the vertical frame members are positioned and their feet are fastened to the medial channels of the sill sections; the cap sections are fastened to the heads of the frame members; the studs and exterior walls are positioned within the lateral channels of the cap and sill sections; and the merchandise display appendages are inserted into the studs.

This description of the preferred embodiment, of course, is not intended to unduly limit the breadth of the invention or the scope of the following claims.

I claim:

1. A prefabricated, free standing wall comprising:

(a) an elongated floor-mounted, substantially horizontally disposed sill member formed with upwardly opening, longitudinally coextensive, transversely spaced apart, medial and first and second lateral channels;

(b) an elongated substantially horizontally disposed cap member formed with downwardly opening, longitudinally coextensive transversely spaced apart, medial and first and second lateral channels;

(c) a plurality of substantially vertically disposed frame members extending between and connecting said sill and cap members in relatively spaced apart, coplanar relation, each of said frame members having laterally outwardly projecting, horizontally extended foot and head sections secured in the medial channels of said sill and cap members, respectively;

(d) a plurality of substantially vertically disposed, horizontally spaced apart panel-positioning studs having opposite end portions positioned in each of the first and second lateral channels of said sill and cap members; and (e) at least two, coplanar wall panels removably carried in each of the first and second lateral channels of said sill and cap members and having adjacent edges thereof disposed in abutment with and separated by one of said studs.

2. A wall according to claim 1, wherein each of said studs is of integral, hollow form construction and includes a pair of relatively spaced apart, longitudinally coextensive, outwardly projecting panel-separating ribs.

3. A wall according to claim 1, wherein each of said sill and cap members includes at least two angularly adjoining sections.

4. A wall according to claim 1 which also includes vertically adjustable leveling means interposed between said sill member and an underlying floor.

* * * * *